US011040398B2

(12) United States Patent
Sonoda

(10) Patent No.: US 11,040,398 B2
(45) Date of Patent: Jun. 22, 2021

(54) METHOD FOR PRODUCING SINTERED COMPONENT, AND SINTERED COMPONENT

(71) Applicant: SUMITOMO ELECTRIC SINTERED ALLOY, LTD., Takahashi (JP)

(72) Inventor: Yasunori Sonoda, Takahashi (JP)

(73) Assignee: SUMITOMO ELECTRIC SINTERED ALLOY, LTD., Takahashi (JP)

( * ) Notice: Subject to any disclaimer, the term of this patent is extended or adjusted under 35 U.S.C. 154(b) by 14 days.

(21) Appl. No.: 16/481,561

(22) PCT Filed: Oct. 27, 2017

(86) PCT No.: PCT/JP2017/038857
§ 371 (c)(1),
(2) Date: Jul. 29, 2019

(87) PCT Pub. No.: WO2018/146868
PCT Pub. Date: Aug. 16, 2018

(65) Prior Publication Data

US 2019/0366439 A1 Dec. 5, 2019

(30) Foreign Application Priority Data

Feb. 8, 2017 (JP) ..... JP2017-021690

(51) Int. Cl.
*B22F 3/24* (2006.01)
*B22F 3/10* (2006.01)

(52) U.S. Cl.
CPC ..... *B22F 3/24* (2013.01); *B22F 3/10* (2013.01); *B22F 2003/247* (2013.01)

(58) Field of Classification Search
None
See application file for complete search history.

(56) References Cited

U.S. PATENT DOCUMENTS

2009/0038450 A1* 2/2009 Campbell ..... B23C 5/08 82/1.11
2015/0217371 A1* 8/2015 Narumi ..... B22F 3/02 419/23

FOREIGN PATENT DOCUMENTS

JP 2002348601 A * 12/2002 ..... B22F 1/02
JP 2006-336078 A 12/2006
(Continued)

OTHER PUBLICATIONS

Naval Education and Training Program Development Center. (1969). Basic Optics and Optical Instruments (Revised Edition)—9.4.3.1 Setup Procedures. (pp. 9-45). Dover Publications. (Year: 1969).*
(Continued)

*Primary Examiner* — Keith D. Hendricks
*Assistant Examiner* — Joshua S Carpenter
(74) *Attorney, Agent, or Firm* — Faegre Drinker Biddle & Reath LLP

(57) ABSTRACT

A method for producing a sintered component includes: a compacting step of press-compacting a raw material powder containing a plurality of metal particles to form a compact; a cutting-machining step of rotating a cutting tool circumferentially having a plurality of cutting edges to cause the cutting edges to intermittently cut a surface of the compact; and a sintering step of sintering the compact after the cutting-machining step. The cutting speed of the cutting tool is 1000 m/min or more.

4 Claims, 4 Drawing Sheets

(56) References Cited

FOREIGN PATENT DOCUMENTS

| | | | | |
|---|---|---|---|---|
| JP | 2007-77468 | A | | 3/2007 |
| JP | 2007077468 | A | * | 3/2007 |
| JP | 2013-108173 | A | | 6/2013 |
| JP | 2013108173 | A | * | 6/2013 |
| JP | 2015-143376 | A | | 8/2015 |

OTHER PUBLICATIONS

Espacenet machine translation of JP-2007077468-A retrieved on Jul. 6, 2020 (Year: 2007).*
Espacenet machine translation of JP-2013108173-A retrieved on Jul. 6, 2020 (Year: 2013).*
Harry E. Chandler, Machining of Powder Metallurgy Materials, Machining, vol. 16, ASM Handbook, ASM International, 1989, p. 879-892 (Year: 1989).*
Espacenet machine translation of JP2002348601A retrieved on Jan. 9, 2021 (Year: 2002).*
First Office Action dated Dec. 28, 2020 from corresponding Chinese patent application No. 201780085915.9 (with attached English-language translation).
Chen Yaoping, Book 1: "Programming and Operation of CNC Milling Machines," Xiangtan University Press, p. 210, Jun. 2015.
Zhou Shuzhu, Book 2: "Hard Materials and Tools," Metallurgical Industry Press, p. 143, Aug. 2015.

* cited by examiner

METHOD FOR PRODUCING SINTERED COMPONENT, AND SINTERED COMPONENT

TECHNICAL FIELD

The present invention relates to a method for producing a sintered component, and a sintered component.

This application claims priority to Japanese Patent Application No. 2017-021690 filed Feb. 8, 2017, which is incorporated herein by reference in its entirety.

BACKGROUND ART

The manufacture of a sintered component normally involves press-compacting a raw material powder containing a metal powder to form a compact and sintering the compact. The sintered component may be subjected to machining (cutting machining) serving as finish machining. For example, in PTL 1, a compact is sintered and then subjected to drilling (cutting machining) serving as finish machining to manufacture a sintered component.

CITATION LIST

Patent Literature

PTL 1: Japanese Unexamined Patent Application Publication No. 2006-336078

SUMMARY OF INVENTION

A method for producing a sintered component according to the present disclosure includes:

a compacting step of press-compacting a raw material powder containing a plurality of metal particles to form a compact;

a cutting-machining step of rotating a cutting tool circumferentially having a plurality of cutting edges to cause the cutting edges to intermittently cut a surface of the compact; and a sintering step of sintering the compact after the cutting-machining step, wherein a cutting speed of the cutting tool is 1000 m/min or more.

A sintered component according to the present disclosure is a sintered component containing metal particles bonded to each other, wherein a sintered surface of the sintered component has a smooth surface with a ten-point average roughness Rz of 10 μm or less, and the smooth surface has a stretched portion in which the metal particles are stretched by plastic deformation to at least partially cover pores between the metal particles.

DESCRIPTION OF EMBODIMENTS

Problems to be Solved by Invention

Figure 1:
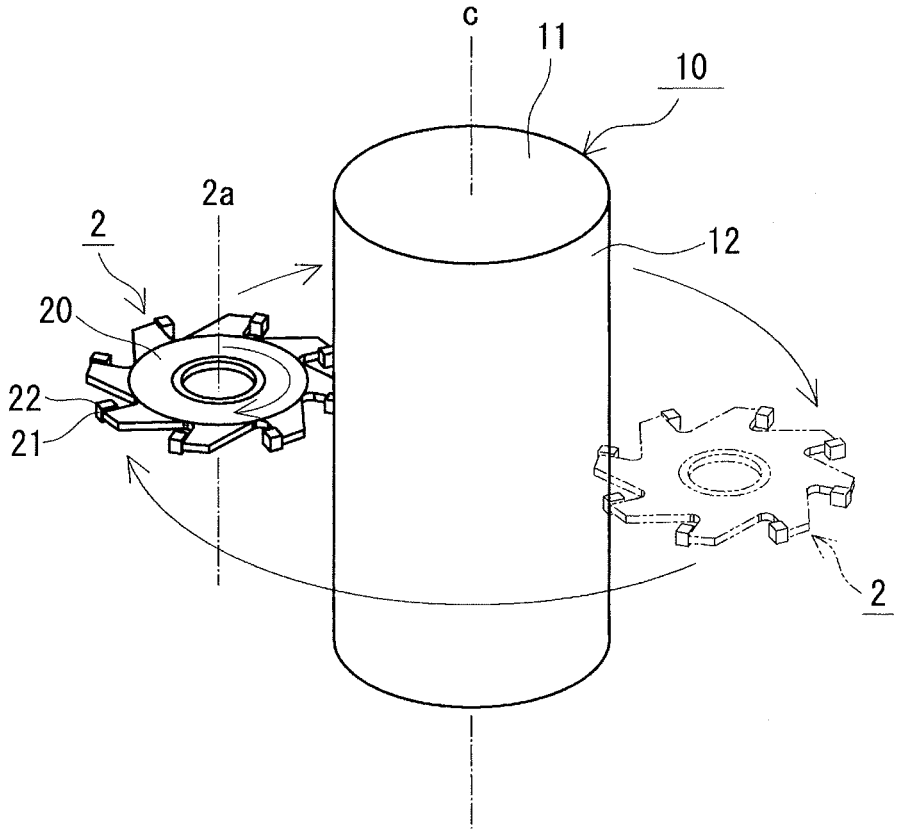
FIG. 1 is a schematic perspective view of a method for producing a sintered component according to a first embodiment.

A sintered component is much harder than a compact before sintering. This is because a sintered component is formed by diffusion-bonding and alloying metal powder particles to/with each other through sintering so that the metal powder particles are strongly bonded to each other, whereas a compact is formed by only compacting a raw material powder so that the metal powder particles mechanically adhere to each other. Thus, cutting machining on the sintered component itself tends to extend the machining time. As a result, it is difficult to improve productivity, and also the life of a tool tends to become short. There is also a possibility that flaws, such as cracks, may be formed in a sintered component depending on the machined area of the sintered component.

A compact before sintering may be subjected to cutting machining, but there is a possibility that the cutting-machined surface may have unfavorable surface texture. A compact is softer than a sintered component. Therefore, cutting machining easily causes the particles in the surface of the compact to fall off from the compact. Continuous cutting tends to form built-up edges on the cutting edges. The formation of the built-up edges causes machining in which the particles in the surface of the compact more easily fall off from the compact, which easily results in high surface roughness. In addition, pores tend to be formed in the surface.

An object is to provide a method for producing a sintered component by which method a sintered component having a smooth surface with a few pores can be manufactured.

Another object is to provide a sintered component having a smooth surface with a few pores.

Advantageous Effects of Present Invention

According to the present disclosure, a sintered component having a smooth surface with a few pores can be manufactured.

The sintered component according to the present disclosure has a smooth surface with a few pores.

DESCRIPTION OF EMBODIMENTS OF PRESENT INVENTION

First, features of embodiments of the present invention will be listed and described.

(1) A method for producing a sintered component according to an aspect of the present invention includes:

a compacting step of press-compacting a raw material powder containing a plurality of metal particles to form a compact;

a cutting-machining step of rotating a cutting tool circumferentially having a plurality of cutting edges to cause the cutting edges to intermittently cut a surface of the compact; and a sintering step of sintering the compact after the cutting-machining step, wherein the cutting speed of the cutting tool is 1000 m/min or more.

According to the foregoing features, a sintered component having a smooth surface with a few pores is easily manufactured. At a high cutting speed, the metal particles in the surface of the compact are sheared and plastically deformed. Shearing of the metal particles with the cutting tool tends to make the surface of the compact smooth, and plastic deformation of the metal particles tends to stretch the metal particles so that the metal particles cover pores in the surface of the compact. At a high cutting speed, it is more difficult to form built-up edges than at a low cutting speed. In addition, intermittent cutting with the cutting edges makes it more difficult to form built-up edges than continuous cutting. Therefore, the surface is unlikely to become rough, and it is difficult to form pores. Moreover, there is no need for, for example, finish machining on the surface of the sintered component.

(2) In an aspect of the method for producing the sintered component, the cutting-machining step involves down cutting in which the cutting tool is made to revolve around the compact in the same direction as the rotation direction of the cutting tool.

According to the foregoing features, down cutting makes it easier to manufacture a sintered component having a smooth surface with a few pores than up cutting.

(3) In an aspect of the method for producing a sintered component, the surface of the compact has a curved surface, and the cutting-machining step involves cutting the curved surface of the compact with the axis of rotation of the cutting tool parallel to the axis passing through the center of the compact.

According to the foregoing features, the cutting edges of the cutting tool are easily brought into point contact with the curved surface, which makes it easy to manufacture a sintered component having a smooth surface with a few pores.

(4) The sintered component according to an aspect of the present invention is a sintered component containing metal particles bonded to each other, wherein a sintered surface of the sintered component has a smooth surface with a ten-point average roughness Rz of 10 μm or less, and the smooth surface has a stretched portion in which the metal particles are stretched by plastic deformation to at least partially cover pores between the metal particles.

According to the foregoing features, the sintered component has a smooth surface with a few pores.

(5) In an aspect of the sintered component, the sintered surface has a rough surface with a ten-point average roughness Rz of more than 10 μm, and the smooth surface has fewer pores than the rough surface.

According to the foregoing features, the sintered component has a smooth surface with a few pores.

(6) In an aspect of the method for producing a sintered component, the method for producing a sintered component includes:

a compacting step of press-compacting a ferrous material powder to form a compact having a density of 6.8 g/cm$^3$ or more and 7.4 g/cm$^3$ or less;

a cutting-machining step of rotating a side cutter circumferentially having a plurality of cutting edges to cut an outer circumference of the compact; and a sintering step of sintering the compact after the cutting-machining step, wherein the cutting speed of the side cutter is 1400 m/min or more.

According to the foregoing features, a sintered component having a smooth surface with a few pores is easily manufactured.

DETAILS OF EMBODIMENTS OF PRESENT INVENTION

The details of the embodiments of the present invention will be described below. The description of the embodiments will be provided in the following order: a method for producing a sintered component and a sintered component.

[Method for Producing Sintered Component]

A method for producing a sintered component according to an embodiment includes a compacting step of forming a compact; a cutting-machining step of cutting-machining the compact; and a sintering step of sintering the compact after the cutting-machining step. One of the features of the method for producing a sintered component is that the cutting-machining step involves intermittent cutting with a plurality of cutting edges of a cutting tool having the cutting edges at a high speed. Hereinafter, specific description of each step will be provided appropriately referring to FIG. 1.

[Compacting Step]

The compacting step involves press-compacting a raw material powder containing a plurality of metal particles to form a compact. The compact is a source material of mechanical components to be commercially produced through sintering described below.

(Raw Material Powder)

The raw material powder contains as a base a metal powder having a plurality of metal particles. The material of the metal powder can be appropriately selected according to the material of a sintered component to be manufactured. Typical examples of the material include ferrous materials.

The ferrous material refers to iron or an iron alloy containing iron as a main component. Examples of the iron alloy include those containing one or more additive elements selected from Ni, Cu, Cr, Mo, Mn, C, Si, Al, P, B, N, and Co. Specific examples of the iron alloy include stainless steel, a Fe—C alloy, a Fe—Cu—Ni—Mo alloy, a Fe—Ni—Mo—Mn alloy, a Fe—P alloy, a Fe—Cu alloy, a Fe—Cu—C alloy, a Fe—Cu—Mo alloy, a Fe—Ni—Mo—Cu—C alloy, a Fe—Ni—Cu alloy, a Fe—Ni—Mo—C alloy, a Fe—Ni—Cr alloy, a Fe—Ni—Mo—Cr alloy, a Fe—Cr alloy, a Fe—Mo—Cr alloy, a Fe—Cr—C alloy, a Fe—Ni—C alloy, and a Fe—Mo—Mn—Cr—C alloy. A ferrous sintered component is obtained by using a ferrous material powder as a base. In the case where a ferrous material powder is used as a base, the amount of the ferrous material powder is, for example, 90 mass % or more, and further 95 mass % or more relative to 100 mass % of the raw material powder.

In the case where a ferrous material powder, particularly an iron powder, is used as a base, a powder of a metal, such as Cu, Ni, and Mo, may be added as an alloying ingredient. Copper Cu, nickel Ni, and molybdenum Mo are elements that improve hardenability. The amount of these elements added is, for example, more than 0 mass % and 5 mass % or less, and further 0.1 mass % or more and 2 mass % or less relative to 100 mass % of the raw material powder. A non-metal inorganic material, such as carbon (graphite) powder, may be added. Carbon C is an element that improves the strength of the sintered component or the heated body thereof. The amount of carbon C is, for example, more than 0 mass % and 2 mass % or less, and further 0.1 mass % or more and 1 mass % or less relative to 100 mass % of the raw material powder.

The raw material powder preferably contains a lubricant. The presence of the lubricant in the raw material powder improves lubricity during compacting when the raw material powder is press-compacted to form a compact. Thus, a dense compact is easily obtained even at a low press-compacting pressure, and a highly-density sintered component is easily obtained by increasing the density of the compact. Moreover, in the case where the raw material powder contains the lubricant, the lubricant is dispersed in the compact. Thus, the lubricant also functions as a lubricant for the cutting tool during cutting machining of the compact with the cutting tool in the post process. Therefore, the lubricant can reduce cutting resistance and improve the life of the tool.

Examples of the lubricant include metal soaps, such as zinc stearate and lithium stearate; fatty acid amides, such as stearamide; and higher fatty acid amides, such as ethylene bis-stearamide. The lubricant may be in any form, such as solid, powder, or liquid. The amount of the lubricant is, for example, 2 mass % or less, and further 1 mass % or less relative to 100 mass % of the raw material powder. In the case where the amount of the lubricant is 2 mass % or less, the compact can contain a large proportion of the metal powder. Therefore, a dense compact with high strength is easily obtained even at a low press-compacting pressure. Moreover, the volume shrinkage caused as a result of the loss of the lubricant during sintering of the compact in the post process can be suppressed, and a highly dense sintered component with high dimensional precision is easily obtained. The amount of the lubricant is preferably 0.1 mass % or more and more preferably 0.5 mass % or more to obtain the effect of improving lubricity.

The raw material powder is free of an organic binder. In the case where the raw material powder is free of an organic binder, the compact can contain a large proportion of the metal powder, and a dense compact is easily obtained even at a low press-compacting pressure. Moreover, there is no need to degrease the compact in the post process.

The raw material powder contains the foregoing metal powder as a base and can contain unaporeable impurities.

The metal powder may be, for example, water atomized powder, reduced powder, or gas atomized powder. In particular, the metal powder is preferably water atomized powder or reduced powder. Since the surfaces of the particles of water atomized powder or reduced powder have many recesses and protrusions, the recesses and protrusions of the particles mate with each other during compacting to increase the shape retention ability of the compact. In general, gas atomized powder tends to provide particles having the surfaces with a few recesses and protrusions, whereas water atomized powder or reduced powder tends to provide particles having the surfaces with many recesses and protrusions.

The average particle size of the metal powder is, for example, 20 μm or more, and further 50 μm or more and 150 μm or less. The average particle size of the metal powder refers to a particle size (D50) at the 50% cumulative volume in the volume particle size distribution determined with a laser diffractometry particle size distribution measuring apparatus. In the case where the average particle size of the metal powder is in the above-described range, it is easy to handle and press-compact the raw material powder.

(Press-Compacting)

Press-compacting is performed by using, for example, a suitable compacting device (compacting die) that can compact the raw material powder into, for example, a shape in conformity with the final shape of a mechanical component or into a shape suitable for cutting-machining in the post process. Examples of the shape include a shape with a curved surface, specifically, a cylindrical shape or a hollow cylindrical shape. The compact with a cylindrical shape or a hollow cylindrical shape is produced by performing press-compacting in the axial direction of a cylinder or hollow cylinder.

The shape of a compact 10 is cylindrical, as illustrated in FIG. 1. The compact 10 can be formed by using, for example, upper and lower punches that each have a circular pressing surface and forms opposing end surfaces 11 of the compact 10 and a die that has a circular insertion hole and forms an outer surface 12 of the compact 10. The opposing end surfaces 11 of the compact 10 in the axial direction are pressed surfaces formed by pressing with the upper and lower punches, and the outer surface 12 is a surface in sliding contact with the die. The surfaces (the pressed surfaces and the sliding contact surface) of the compact 10 have a ten-point average roughness Rz of more than 10 μm.

The pressure of press-compacting is, for example, 250 MPa or more and 800 MPa or less.

The density of the compact is, for example, 6.8 g/cm$^3$ or more and 7.4 g/cm$^3$ or less.

[Cutting-Machining Step]

The cutting-machining step involves subjecting the surface of the compact 10 to cutting machining with a cutting tool 2. The cutting machining is performed in such a manner that the cutting tool 2 circumferentially having a plurality of cutting edges 22 is rotated to cause the cutting edges 22 to intermittently cut the surface of the compact 10. Intermittent cutting tends to suppress an increase in the temperature of each cutting edge 22 compared to continuous cutting. It is thus easy to suppress formation of built-up edges, which can suppress an increase in the surface roughness of the cutting-machined surface due to formation of built-up edges. In this machining, cutting is preferably performed in such a manner that a component force (main component force) acting in the cutting direction, of the cutting force acting on the cutting tool 2, becomes smaller than the bonding strength between the particles of the powder of the compact 10 (the transverse rupture strength of the compact 10). Such machining makes it easy to manufacture the compact 10 having a smooth surface with a few pores surrounded by the metal particles.

Examples of the cutting tool 2 include a milling cutter, specifically, a side cutter. As illustrated in FIG. 1, the cutting tool 2 has a ring-shaped body 20 and a plurality of chips 21 having the cutting edges 22. The chips 21 are fixed to the circumference of the body 20 at appropriate intervals. The chips 21 may be fixed to the body 20 itself, or may be fixed to the body 20 with blades (not illustrated) interposed therebetween. The cutting tool 2 may be a milling cutter having cutting edges 22 formed in a body 20 itself, instead of the milling cutter having the chips 21 attached to the body 20. The surface of the base material of the chip 21 is preferably coated with a heat-resistant coating. Examples of the material of the cutting tool 2 (base material) include appropriate high-strength materials used for machining of compacts (ferrous materials), such as cemented carbides, cermets, and high-speed steels.

The cutting speed of the cutting tool 2 is as high as 1000 m/min or more. High-speed cutting tends to plastically deform the metal particles while shearing the metal particles and thus makes it easy to manufacture the compact 10 having a smooth surface with a few pores. Shearing of the metal particles with the cutting tool 2 tends to make the surface of the compact 10 smooth, and plastic deformation of the metal particles tends to stretch the metal particles so that the metal particles cover pores in the surface of the compact 10. The cutting speed of the cutting tool 2 may be further 1200 m/min or more, and particularly 1500 m/min or more. The upper limit of the cutting speed of the cutting tool 2 is practically, for example, about 2500 m/min.

The cutting machining may be performed by rotating the cutting tool 2 without revolution of the cutting tool 2 around the compact 10, or may be performed by making the cutting tool 2 rotate and revolve. In the case where the cutting tool 2 is rotated without revolution, the compact 10 may be rotated without revolution. In the case where the cutting tool 2 is made to rotate and revolve, the compact 10 may be rotated without revolution, or may be fixed without rotation or revolution. In either case, the cutting machining is preferably performed by down cutting. Down cutting makes it easier to form a smoother flat surface than up cutting. Specifically, in the case where the cutting tool 2 is rotated without revolution and the compact 10 is rotated without revolution, the rotation direction of the cutting tool 2 is opposite to the rotation direction of the compact 10. In the case where the cutting tool 2 is made to rotate and revolve and the compact 10 is rotated without revolution, the cutting tool 2 may revolve in any direction as long as the rotation direction of the cutting tool 2 is opposite to the rotation direction of the compact 10. In the case where the cutting tool 2 is made to rotate and revolve and the compact 10 is fixed without rotation or revolution, the rotation direction of the cutting tool 2 is the same as the revolution direction of the cutting tool 2.

The cutting machining is preferably performed with an axis 2*a* of rotation of the cutting tool 2 parallel to the axis c passing through the center of the compact 10. The axis c passing through the center of the compact 10 corresponds to the axis 2*a* of rotation of the compact 10 in the case where the compact 10 rotates, and corresponds to the revolution axis of the cutting tool 2 in the case where the cutting tool 2 revolves. In the case where the compact 10 is in the shape of a cylinder or a hollow cylinder, the axis c passing through the center of the compact 10 corresponds to the axis of the cylinder or the hollow cylinder. In this case, the surface of the compact 10 to be subjected to cutting machining is a curved surface (outer surface 12). This configuration makes it easy to manufacture the compact 10 having a smooth surface with a few pores. This is because it is easy to bring the cutting tool 2 and the compact 10 into point contact with each other. The distance between the axis 2*a* of rotation of the cutting tool 2 and the axis c passing through the center of the compact 10 is preferably variable. This enables formation of a shape, such as a spherical portion, in which the diameter of the compact 10 varies in the axial direction of the compact 10. In the case of forming a spherical portion, the revolution diameter may be variable.

The rake angle of each cutting edge 22 of the cutting tool 2 is preferably, for example, 0° or more. This configuration makes it easy to form a compact having a smooth surface with a few pores. The upper limit of the rake angle is, for example, about 90°. The rake angle of each cutting edge 22 is more preferably 0° or more and 45° or less and still more preferably 0° or more and 5° or less.

In addition, for example, in the case where the cutting tool 2 is rotated without revolution, the compact 10 may be made to revolve around the cutting tool 2 without rotation of the compact 10, or the compact 10 may be made to rotate and revolve. In the former case, the rotation direction of the cutting tool 2 is the same as the revolution direction of the compact 10. In the latter case, the compact 10 may revolve in any direction as long as the rotation direction of the cutting tool 2 is opposite to the rotation direction of the compact 10. In the case where the compact 10 is made to rotate and revolve, the rotation velocity and the revolution velocity of the compact 10 are controlled in such a manner that the rotation period of the compact 10 is out of synchronization with the revolution period of the compact 10. The number of rotation or the number of revolution of the compact 10 is such that the compact 10 is not damaged by rotation or revolution (e.g., the metal particles that constitute the compact 10 do not fall off). For example, in the case where the diameter of the compact 10 is 100 mm, the number of rotation of the compact 10 is, for example, about 1800 rpm or less.

The ten-point average roughness Rz of the cutting-machined surface of the compact 10 is, for example, 10 μm or less. The ten-point average roughness Rz of the cutting-machined surface of the compact 10 may be 8.5 μm or less, and particularly 5 μm or less. The lower limit of the ten-point average roughness Rz of the cutting-machined surface of the compact 10 is, for example, about 1 μm. The ten-point average roughness Rz of the surfaces of the compact 10 other than the cutting-machined surface is more than 10 μm. The surface textures of the cutting-machined surface and the other surfaces of the compact 10 are substantially maintained even after sintering described below.

[Sintering Step]

The sintering step involves sintering the cutting-machined compact 10. The sintering provides the sintered component specifically described below. The sintering uses, for example, an appropriate sintering furnace (not illustrated). The temperature of the sintering may be an appropriately selected temperature required for sintering according to the material of the compact 10 and is, for example, 1000° C. or higher, further 1100° C. or higher, and particularly 1200° C. or higher. The sintering time is, for example, about 20 minutes or longer and 150 minutes or longer.

[Applications]

The method for producing a sintered component according to the embodiment can be preferably applied to the manufacture of various ordinary structural components (sintered components, such as mechanical components, including sprockets, rotors, gears, rings, flanges, pulleys, and bearings).

[Operation and Effect]

According to the method for producing a sintered component according to the embodiment, a sintered component having a smooth surface with a few pores is easily manufactured. Since high-speed cutting shears and plastically deforms the metal particles in the surface of the compact 10, shearing of the metal particles tends to make the surface of the compact 10 smooth, and plastic deformation of the metal particles tends to stretch the metal particles so that the metal particles cover pores in the surface of the compact 10. Moreover, high-speed cutting and intermittent cutting make it difficult to form a built-up edge on each cutting edge 22, which can suppress an increase in surface roughness.

[Sintered Component]

The sintered component contains metal particles bonded to each other. The surface of the sintered component is substantially entirely formed of a sintered surface. The sintered surface has a smooth surface and a rough surface. This sintered component can be manufactured by using the method for producing the sintered component. The surface texture of the sintered component or the like is substantially the same as the surface texture of the compact.

[Smooth Surface]

The smooth surface has a ten-point average roughness Rz of 10 μm or less. The ten-point average roughness Rz of the smooth surface is preferably 8.5 μm or less, and more preferably 5 μm or less. The lower limit of the ten-point average roughness Rz of the smooth surface is, for example, about 1 μm. The smooth surface is formed of a curved surface in many cases. The smooth surface has stretched portions in which the metal particles are stretched by plastic deformation to at least partially cover pores between the metal particles. The direction in which the metal particles are stretched in the stretched portions is oriented along the circumferential direction of the smooth surface. This is because this cutting machining is performed with the axis 2*a* of rotation of the cutting tool 2 parallel to the axis c passing through the center of the compact 10. The stretched portions are formed in the shape of lines in the circumferential direction of the smooth surface. The line-shaped stretched portions are arranged in the axial direction of the smooth surface. The smooth surface has fewer pores than the rough surface.

[Rough Surface]

The rough surface has a ten-point average roughness Rz of more than 10 μm. The ten-point average roughness Rz of the rough surface may be further 25 μm or more, and particularly 50 μm or more. The upper limit of the ten-point average roughness Rz of the rough surface may be, for example, about 100 μm. Unlike the smooth surface, the rough surface has substantially no stretched surface. In other words, the rough surface has more pores than the smooth surface. The rough surface is formed of a flat surface in many cases, and the flat surface has a circular shape in many cases. The rough surface is a surface of the compact 10 that is not subjected to cutting machining and, after the compacting step, maintains the surface texture obtained before cutting machining.

[Applications]

The sintered component according to the embodiment can be preferably applied to various ordinary structural components (sintered components, such as mechanical components, including sprockets, rotors, gears, rings, flanges, pulleys, and bearings).

[Operation and Effect]

The sintered component according to the embodiment can have a smooth surface with a few pores.

Test Example 1

The difference in the surface roughness of the compact due to the difference in cutting speed was evaluated.

[Sample No. 1-1]

The cutting-machined compact of Sample No. 1-1 was produced through the compacting step and the cutting-machining step described in the method for producing the sintered component.

[Compacting Step]

As a raw material powder, a powder mixture of an iron alloy powder (composition: 2 mass % Cu-0.8 mass % C-balance being Fe and unaporeable impurities, D50: 100 μm) and ethylene bis-stearamide was prepared.

The raw material powder was charged into a given compacting die that provides the compact 10 having a cylindrical shape as illustrated in FIG. 1. The raw material powder was press-compacted at a pressing pressure of 600 MPa to form the compact 10 having a cylindrical shape (outer diameter: 65 mm, height (length in axial direction): 55 mm). The density of the compact 10 was 6.9 g/cm$^3$. The density was an apparent density calculated from size and mass.

[Cutting-Machining Step]

The cutting-machining step involves subjecting the outer surface 12 (curved surface) of the compact 10 to cutting machining. The cutting tool was a side cutter available from SANKYO TOOL CO., LTD., material: JIS standard SKH51, cutter diameter: 75 mm×hole diameter: 25.4 mm, number of flutes: 12 (corner: 4R). The number of rotation of the cutting tool was 6000 rpm, and the cutting speed of the cutting tool was 1400 m/min. In this step, the compact 10 was fixed without rotation, and the cutting tool was made to rotate and revolve around the outer surface 12 of the compact 10. The rotation direction of the cutting tool was the same as the revolution direction of the cutting tool. The end surfaces 11, which were pressed surfaces of the compact 10, were not subjected to cutting machining.

[Sample No. 1-101]

The compact of Sample No. 1-101 was produced by subjecting the outer surface of the compact 10 to cutting machining in the same manner as for Sample No. 1-1 except that the number of rotation of the cutting tool was 510 rpm and the cutting speed of the cutting tool was 120 m/min.

[Evaluation of Surface Roughness]

The ten-point average roughness Rz of the cutting-machined surface of the compact of each sample was measured. The ten-point average roughness Rz was measured in accordance with "Geometrical Product Specifications (GPS)-Surface texture: Profile method-Terms, definitions and surface texture parameters JIS B 0601 (2013)."

The ten-point average roughness Rz of the cutting-machined surface in the compact of Sample No. 1-1 was 8.3 μm. The ten-point average roughness Rz of the cutting-machined surface in the compact of Sample No. 1-101 was 30 μm.

The cutting-machined surface and the non-cutting-machined surface (pressed surface) of the compact of Sample No. 1-1 were visually observed. The surface photographs (magnification: 20 times) of the cutting-machined surface and the non-cutting-machined surface were shown in FIG. 2 and FIG. 3, respectively. The left-right direction of FIG. 2 corresponds to the cutting machining direction. It was found that the cutting-machined surface shown in FIG. 2 had fewer pores formed between the particles than the non-cutting-machined surface shown in FIG. 3.

Figure 2:
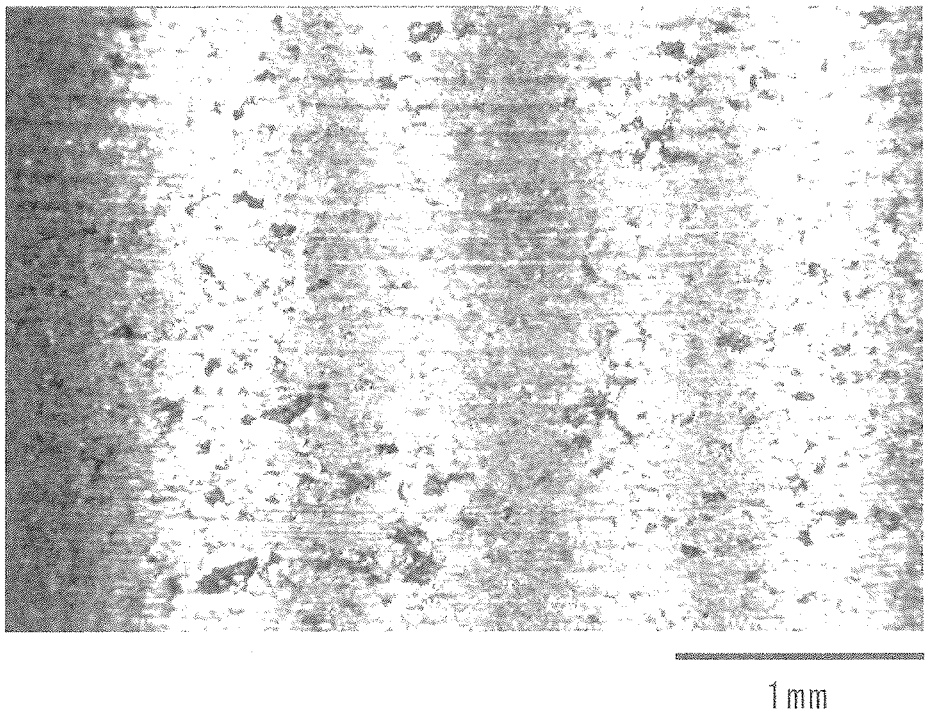
FIG. 2 is a micrograph showing a cutting-machined surface of a compact of Sample No. 1-1.
Figure 3:
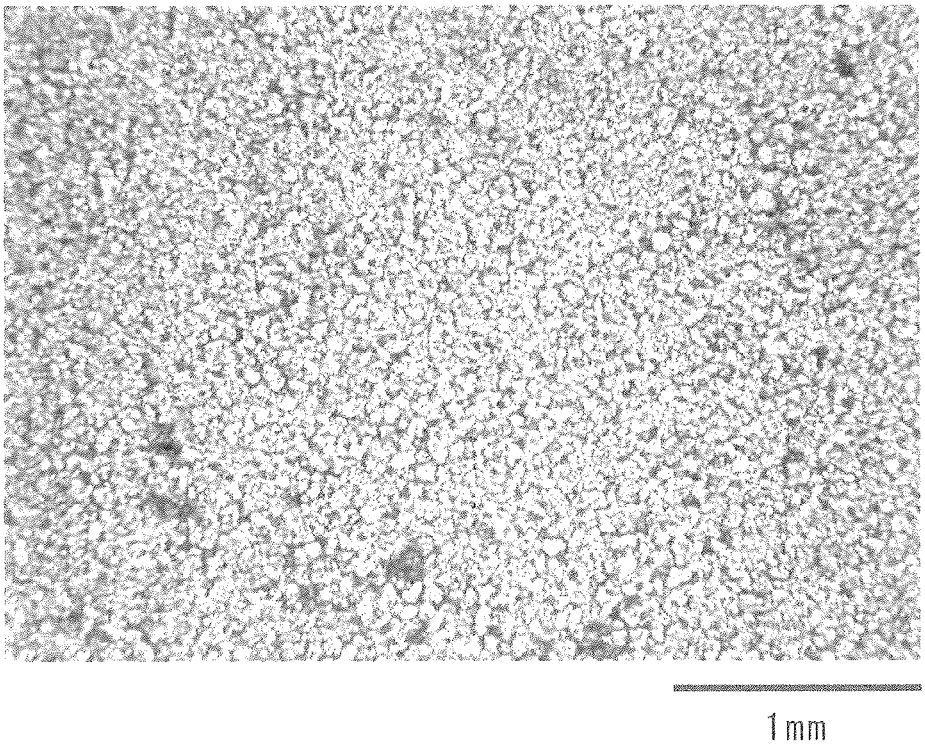
FIG. 3 is a micrograph showing a pressed surface of a compact of Sample No. 1-1.

As shown in FIG. 2, the metal particles in the cutting-machined surface are stretched in the left-right direction of the figure to at least partially cover pores. As shown in FIG. 3, the non-cutting-machined surface has substantially no area where the metal particles are stretched to cover pores. In other words, substantially all pores surrounded by the metal particles are exposed.

Figure 4:
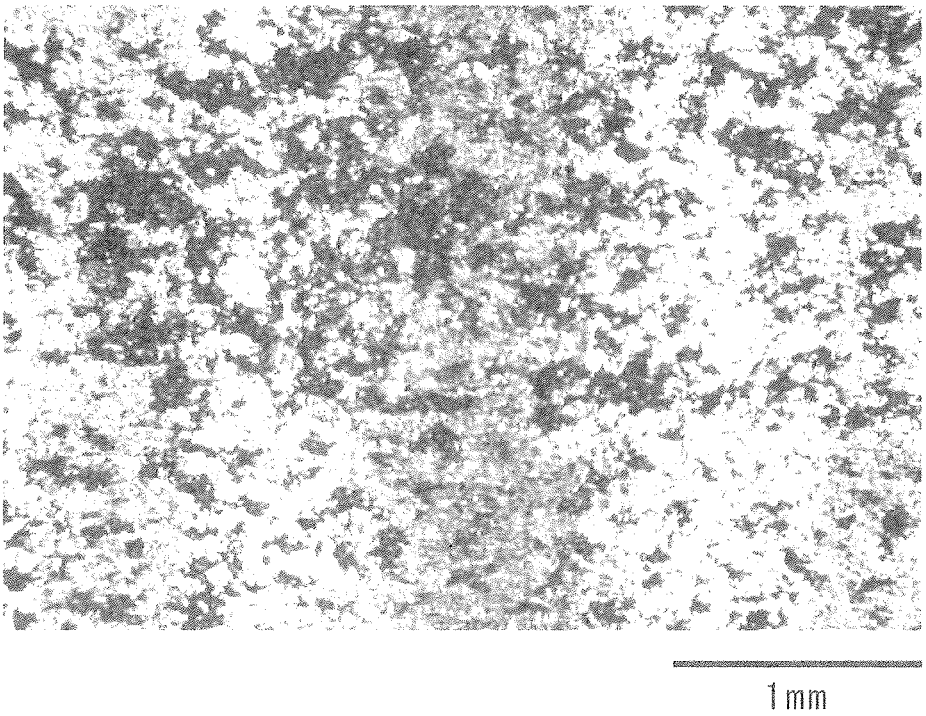
FIG. 4 is a micrograph showing a cutting-machined surface of a compact of Sample No. 1-101.

The cutting-machined surface and the non-cutting-machined surface of the compact of Sample No. 1-101 were visually observed in the same manner as for Sample No. 1-1. The photograph (magnification: 20 times) of the cutting-machined surface is shown in FIG. 4. The left-right direction of FIG. 4 corresponds to the cutting machining direction. As shown in FIG. 4, the metal particles in the cutting-machined surface were hardly stretched in the left-right direction of the figure, and the cutting-machined surface had many pores compared to the cutting-machined surface of Sample No. 1-1.

Compacts were produced under the same conditions as for Sample No. 1-1 except that the cutting speed was 1000 m/min and 2000 m/min. The compacts were then sintered under the conditions of a sintering temperature of 1130° C. and a sintering time of 90 minutes to produce sintered components. It was confirmed that the machined part of each sintered component had a smooth surface, and the sintered components had a smoother surface with fewer pores than the sintered component produced by sintering the compact of Sample No. 1-101.

REFERENCE SIGNS LIST

10 Compact
11 End surface
12 Outer surface
2 Cutting tool
2*a* Axis of rotation
20 Body
21 Chip
22 Cutting edge
c Axis

The invention claimed is:

1. A method for producing a sintered component, the method comprising:

a compacting step of press-compacting a raw material powder containing a plurality of metal particles and a powder lubricant to form a compact;

a cutting-machining step of rotating a cutting tool circumferentially having a plurality of cutting edges to cause the cutting edges to intermittently cut a surface of the compact containing the powder lubricant; and a sintering step of sintering the compact after the cutting-machining step, wherein a cutting speed of the cutting tool is 1000 m/min or more.

2. The method for producing a sintered component according to claim 1, wherein the cutting-machining step involves down cutting in which the cutting tool is made to revolve around the compact in the same direction as a rotation direction of the cutting tool.

3. The method for producing a sintered component according to claim 1, wherein the surface of the compact has a curved surface, and the cutting-machining step involves cutting the curved surface of the compact with an axis of rotation of the cutting tool parallel to an axis passing through a center of the compact.

4. A method for producing a sintered component, the method comprising:

a compacting step of press-compacting a ferrous material powder containing a powder lubricant to form a compact having a density of 6.8 g/cm$^3$ or more and 7.4 g/cm$^3$ or less;

a cutting-machining step of rotating a side cutter circumferentially having a plurality of cutting edges to cut an outer circumference of the compact containing the powder lubricant; and a sintering step of sintering the compact after the cutting-machining step, wherein a cutting speed of the side cutter is 1400 m/min or more.

* * * * *